United States Patent [19]

Stuart et al.

[11] 4,219,390

[45] Aug. 26, 1980

[54] METHOD FOR THE REGENERATION OF A TINNING ELECTROLYTE

[75] Inventors: Eric J. Stuart, Heemskerk; Bob de Mon, Alkmaar, both of Netherlands

[73] Assignee: Hoogovens Ijmuiden, B.V., Ijmuiden, Netherlands

[21] Appl. No.: 943,941

[22] Filed: Sep. 20, 1978

[30] Foreign Application Priority Data

Sep. 22, 1977 [DE] Fed. Rep. of Germany ..... 2742718

[51] Int. Cl.[2] ..... C25D 21/22

[52] U.S. Cl. ..... 204/54 R; 204/120; 204/DIG. 13; 204/237; 210/38 B

[58] Field of Search ..... 204/120, DIG. 13, 121, 204/122, 232, 237, 238, 239, 240, 54 R; 210/24, 38 B

[56] References Cited

U.S. PATENT DOCUMENTS

| | | | |
|---|---|---|---|
| 2,733,204 | 1/1956 | Costa | 210/24 |
| 2,800,447 | 7/1957 | Graham | 204/237 X |
| 3,637,473 | 1/1972 | Greenspan et al. | 204/46 G |

OTHER PUBLICATIONS

R. M. Wheaton et al., J. Chemical Education, vol. 35, pp. 59–65, Feb. 1958.

J. Thompson et al., Plating, pp. 809–812, Aug. 1971.

Albert R. Yeats, Plating & Surface Finishing, pp. 32–33, Apr. 1978.

*Primary Examiner*—G. L. Kaplan

*Attorney, Agent, or Firm*—Stevens, Davis, Miller & Mosher

[57] ABSTRACT

Method for regenerating an electrolytic liquid for tinning purposes in which the electrolytic liquid is freed from ions of foreign metals introduced into it during the tinning action, characterized by the steps of (a) detinning of the electrolytic liquid through electrolysis and (b) releasing of the foreign metal ions by means of a cation exchanger.

2 Claims, 1 Drawing Figure

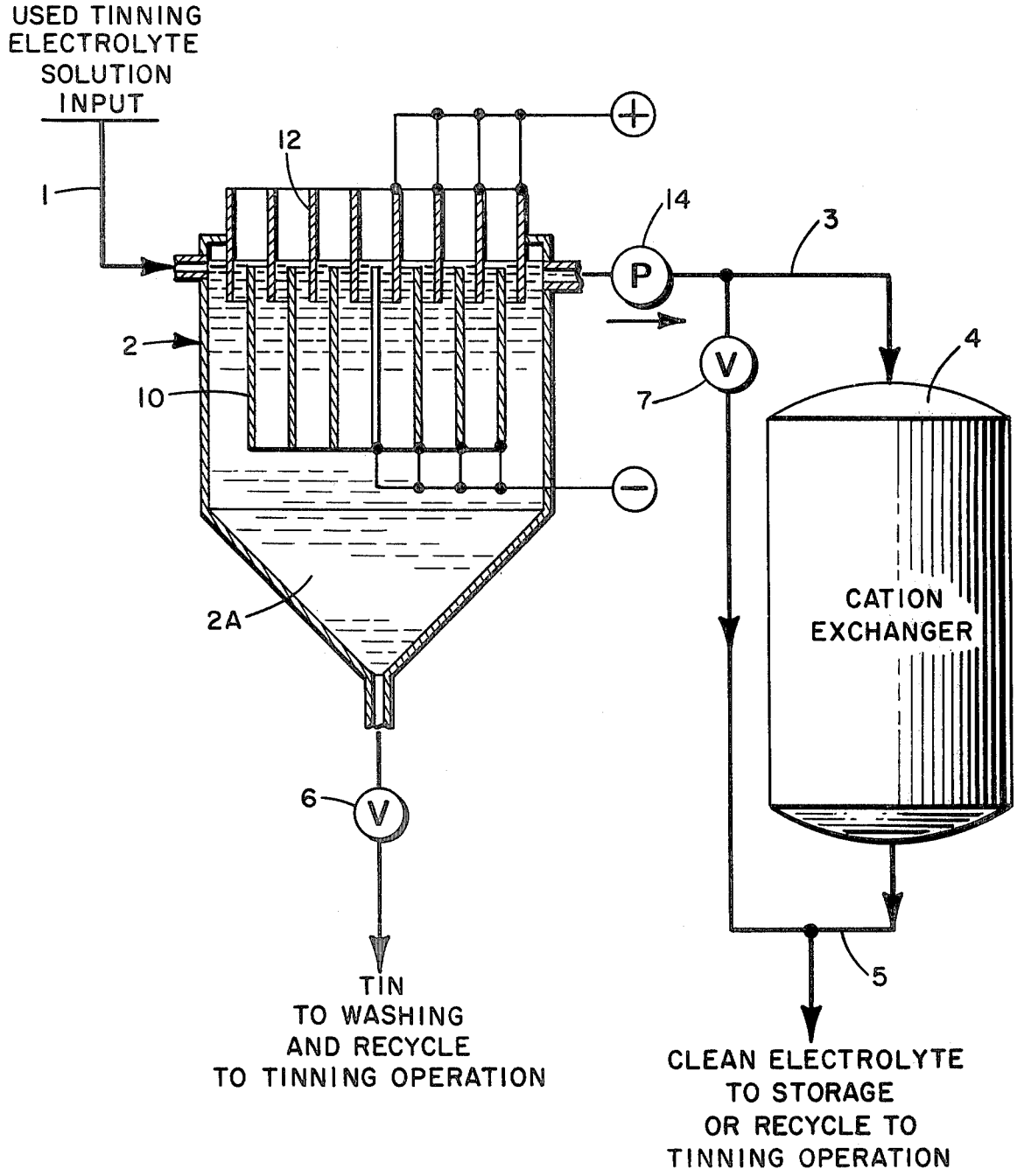
USED TINNING
ELECTROLYTE
SOLUTION
INPUT
1
12
14
3
P
2
10
V
7
4
CATION
EXCHANGER
2A
6
V
5
TIN
TO WASHING
AND RECYCLE
TO TINNING OPERATION
CLEAN ELECTROLYTE
TO STORAGE
OR RECYCLE TO
TINNING OPERATION

METHOD FOR THE REGENERATION OF A TINNING ELECTROLYTE

The invention relates to a method for the regeneration of an electrolyte for tinning purposes in which the ions of foreign metals deposited during the tinning process are removed and also an installation for the regeneration of such an electrolyte.

This installation can in that case particularly be used for the regeneration of an electrolyte for tinning purposes but in a similar way also for the regenerations of other electrolytes used in electrodeposition.

For the electrolytic tinning of metals e.g. steel, the electrolyte is soiled during the tinning process by the (metal) ions of the metal to be tinned. As soon as the fraction of these foreign metal ions in the electrolyte exceeds a certain value, the quality of the tinning process deteriorates, so that the electrolyte is then to be replaced by a new electrolyte.

This is connected with relatively high costs.

The consumed electrolyte is, either directly or after reclamation of the tin contained by the electrolyte, neutralized and discharged as waste-water, and such either—if permitted—into the sewerage or elsewhere. The elimination of the consumed electrolyte is connected with high expenses too. The invention has therefore as an object to supply a method of regenerating of an electrolyte for tinning purposes which enables a reutilization of the electrolytic liquid (electrolyte) and which in addition to offering a considerable cost reduction is also "environment friendly".

The solution of this task is obtained according to the present invention by the combination of the characteristics known per se:

(a) of the detinning of the electrolyte by electrolysis and (b) of the elimination of the foreign metal ions in a certain exchanger The method can proceed continuously as well as discontinuously. By means of the proposed method it is possible to the one hand to reclaim the tin contained in the electrolyte to a high extent, in order to allow its re-use after smelting; on the other hand the electrolyte from which the foreign metal ions have been removed can be used again without any harm. Similarly the new method alleviates considerably the nuisance to the environment. The electrolysis can be continued until an optimal content of tin for the tinning (process) of the electrolyte is reached.

In accordance with the invention, however, it appeared to be of advantage to continue de-tinning almost completely and to add if necessary the required tin-quantity later to the regenerated electrolyte.

The installation which can be used for the new method is in accordance with the invention characterized in that an electrolytic cell and a cation exchanger are arranged in series in the direction of flow of the electrolyte. It is also possible to use this installation for similar processes of electro-deposition as e.g. chrome plating.

The concentration velocity of the electrolyte during tinning with tin resp. foreign metal ions being different from case to case, it is difficult to lay out an optimal installation for any situation possible.

For that reason an installation should be preferred which is provided with reversing means allowing, if so desired, the flow of electrolyte to by-pass the cation exchanger.

The tin separated at the cathode will partly deposit on the cathode. In the case of a discontinuous process it is possible to remove the cathode from the electrolytic cell and to eliminate the tin deposition. The hazard of a short circuit during the de-tinning, however, remains then.

According to the invention this disadvantage, as well as indeed the necessity of removing the cathode by mechanical means in order to eliminate the deposited metal from the cathode in the electrolytic cell, is avoided. For this purpose e.g. a reamer to scrape off the tin can be "used". In order to prevent undesired influencing of the composition of the electrolyte during de-tinning, the known anode of the electrolytic cell consists preferably either of cast silicon or of platinum plated titanium, the known cathode consisting of steel. However, the known anode may be of titanium coated with $IrO_2$ while the known cathode is aluminum.

Further advantages of the invention are exemplified by means of examples of designs shown in the drawing.

This drawing shows the flowsheet of an installation for the regeneration of a tinning electrolyte.

As tinning electrolyte a solution was used containing 150 g. of p-Phenolsulphonic acid per liter. The electrolyte requiring regeneration contains in addition per liter approx. 30 g. of tin; 12 g. of iron and 0.5 g. of other metal ions. Via a conduit 1, the used and enriched (by foreign metal ions) electrolyte of a tinning operation (not shown) is led, sometimes with the interpositioning of a storage tank (not shown), to an electrolytic cell 2 which is known in the art per se.

Here the tin contained in the electrolyte at the cathode 10 is segregated in the form of dendrites by means of electrolysis—which can take place by continuous circulation. Optionally this recycling may comprise a suitable filtering system (not shown).

In order to prevent deterioration of the electrolyte, the anode 12 of the electrolytic cell 2 consists of cast silicon and the cathode of steel.

Because of the aforementioned reasons the tin deposited at the cathode is scraped off by means of a reamer (not shown).

The scraped-off tin drops into a conical lower part 2A of the electrolytic cell 2 and is withdrawn discontinuously and prepared for re-use.

For the discontinuous withdrawal a valve 6 is opened as soon as a sufficient quantity of tin has accumulated at the end of a charge. The collected tin can then be washed consecutively. It is obvious the withdrawal and washing can easily be carried out completely automatic. Instead of discontinuous withdrawal of the tin via a valve, the tin can of course also be removed semi-continuously e.g. by means of an air-lift-pump.

The electrolyte from which the tin has been removed but which still contains foreign metal ions is then pumped by pump 14 to a cation exchanger 4 via conduit 3.

In the conduit 3 between the elctrolytic cell 2 and the cation exchanger 4 can be installed, if so required, a surge tank and/or a filter installation for buffering purposes (both of which are not shown).

The cation exchanger 4 is filled with a highly acid resin bed of the hydrogen type (not shown).

When the electrolyte flows through the resin bed, all foreign metal ions contained in the electrolyte are exchanged against hydrogen ions.

The thus cleaned (regenerated) electrolyte, either flows directly back via a conduit 5 to the tinning operation or is piped to a storage tank.

Upon saturation of the cation exchanger the regeneration of the resin bed is performed in a way known per se.

The tin quantity required for the tinning process can be added to the electrolyte before its re-use. In the case that the electrolyte contains relatively little foreign metal ions with respect to the quantity of tin present, the flow of electrolyte can by-pass the cation exchanger during part of the processing time through conduit 8 by opening a valve 7.

We claim:

1. Method for regenerating an electrolytic liquid for tinning purposes in which the electrolytic liquid if freed from ions of foreign metals introduced into it during the tinning action, characterized by the steps of (a) detinning of the electrolytic liquid through electrolysis and (b) releasing of the foreign metal ions by means of a cation exchanger.

2. Method of claim 1, characterized in that a quantity of tin is supplied to the cleaned electrolytic liquid to raise the tin content to a level for electrolytic deposition.

* * * * *